US008191317B2

(12) United States Patent
Lundsgaard et al.

(10) Patent No.: US 8,191,317 B2
(45) Date of Patent: Jun. 5, 2012

(54) VENTILATED CURB-MOUNT SKYLIGHT WITH SEPARABLE HINGE

(75) Inventors: Christian Aage Lundsgaard, Ry (DK); James Eric Brinton, Greenwood, SC (US)

(73) Assignee: VKR Holding A/S, Hoersholm (DK)

( * ) Notice: Subject to any disclaimer, the term of this patent is extended or adjusted under 35 U.S.C. 154(b) by 398 days.

(21) Appl. No.: 12/179,874

(22) Filed: Jul. 25, 2008

(65) Prior Publication Data

US 2010/0018138 A1 Jan. 28, 2010

(51) Int. Cl.
*E04B 1/346* (2006.01)

(52) U.S. Cl. ..... 52/72; 52/200; 49/349; 49/402

(58) Field of Classification Search ..... 52/200, 52/19, 72, 403, 204.55, 213, 215, 656.5; 49/349, 402, 504
See application file for complete search history.

(56) References Cited

U.S. PATENT DOCUMENTS

| | | | | |
|---|---|---|---|---|
| 4,449,340 | A | 5/1984 | Jentoft et al. | |
| 4,570,393 | A | 2/1986 | Minter | |
| 4,837,986 | A * | 6/1989 | Gagne | 52/1 |
| 4,986,039 | A | 1/1991 | Weisner | |
| 5,097,629 | A | 3/1992 | Guhl et al. | |
| 5,103,603 | A | 4/1992 | Verby et al. | |
| 5,148,643 | A | 9/1992 | Sampson et al. | |
| 5,207,036 | A * | 5/1993 | Sampson et al. | 52/72 |
| 5,355,644 | A * | 10/1994 | Guhl et al. | 52/200 |
| 6,223,484 | B1 | 5/2001 | Minter | |
| 6,532,877 | B1 * | 3/2003 | Hepburn et al. | 105/404 |
| 6,607,020 | B1 | 8/2003 | Jensen et al. | |
| 2002/0095884 | A1 * | 7/2002 | Lindgren et al. | 52/200 |
| 2006/0272232 | A1 | 12/2006 | Fooks | |

FOREIGN PATENT DOCUMENTS

| | | | |
|---|---|---|---|
| DE | 10234430 | A1 | 2/2004 |
| DE | 202004021033 | U1 | 10/2006 |
| EP | 1857630 | A2 | 11/2007 |
| GB | 1580050 | A | 11/1980 |
| WO | WO2007110072 | A1 | 10/2007 |

OTHER PUBLICATIONS

International Search Report for corresponding PCT Application Serial No. PCT/DK2009/000175, prepared by the European Patent Office as International Searching Authority, dated Sep. 25, 2009.

* cited by examiner

*Primary Examiner* — William Gilbert
(74) *Attorney, Agent, or Firm* — Turner Padget Graham & Laney, PA

(57) ABSTRACT

Provided herein is a curb-mounted skylight having a rigid plastic curb frame, a mechanism for firmly securing the curb frame to an opening in a building, a transparent or translucent covering element, and a mechanism for retaining the covering element on the frame. The curb frame includes a fixed base frame (having an interior frame and a counter-flashing element) and a moveable sash frame (having an accessory shelf and a sash). The base frame and the sash frame may be connected to one another by a first hinge member integral with the counter-flashing element and a cooperative and complementary-shaped second hinge member attached to the sash. The hinge members form a watertight seal and may be disengaged to permit the sash to be removed from the skylight assembly during installation, if so desired. Because the frame and hinge components are made of plastic, the skylight assembly is relatively lightweight.

19 Claims, 10 Drawing Sheets

VENTILATED CURB-MOUNT SKYLIGHT WITH SEPARABLE HINGE

TECHNICAL FIELD

This disclosure relates to the field of skylights and skylight constructions and more specifically, to lightweight, ventilated curb-mount skylights.

BACKGROUND

Skylights have been used in architecture for decades as a way of transmitting light into various interior spaces, both in commercial and residential construction. Some skylights are of the fixed type, meaning that their structures do not open, while others are of the opening or operating type, having a mechanism by which the skylight window may be opened to the outside. One consideration with all skylights—and particularly with opening skylights—is how to create and maintain a leak-proof assembly. Many manufacturers have provided their own solutions to this problem with varying degrees of success.

Another issue that may occur in skylight installation relates to the weight of the skylight assembly. Particularly in large skylights, the assembly may weigh more than 100 pounds, making transporting the skylight to a rooftop (for example, by carrying it up a ladder) cumbersome. Others have attempted to address this problem by using separable components, some of which have been more practical than others.

It would be advantageous, therefore, to provide in a single skylight assembly a lightweight, leak-proof construction and an assembly which may be easily assembled and disassembled to facilitate transportation.

SUMMARY

Provided herein is a curb-mounted skylight having a rigid plastic curb frame, a mechanism for firmly securing the curb frame to an opening in a building, a transparent or translucent covering element, and a mechanism for retaining the covering element on the frame. The curb frame includes a fixed base frame (having an interior frame and a counter-flashing element) and a moveable sash frame (having an accessory shelf and a sash). The base frame and the sash frame may be connected to one another by hinge members, a first hinge member being integral with the counter-flashing element, and a cooperative and complementary-shaped second hinge member being attached to the sash. The hinge members form a watertight seal and may be disengaged to permit the sash to be removed from the skylight assembly during installation, if so desired. Because the frame and hinge components are made of plastic, the skylight assembly is much lighter than conventional wood-frame skylights.

BRIEF DESCRIPTION OF THE DRAWINGS

A full and detailed disclosure is set forth in the accompanying specification, which makes reference to the appended figures, in which.

DETAILED DESCRIPTION

Reference is now made to the drawings for illustration of various components of the present skylight assembly. The skylight is adapted to span an opening that is generally of square or rectangular shape. The opening may be defined by upright walls, which may be part of the roof construction, such walls being referred to collectively as a "curb" or, individually, as "curb members." While the particular illustrations provided herein are directed to a curb-mounted skylight, various elements and embodiments may be equally applicable to deck-mounted skylights or self-flashed skylights. It should be noted that, although the skylight assembly is shown as having a substantially flat construction employing flat glass panes, a domed-type skylight covering may instead be employed.

Figure 1:
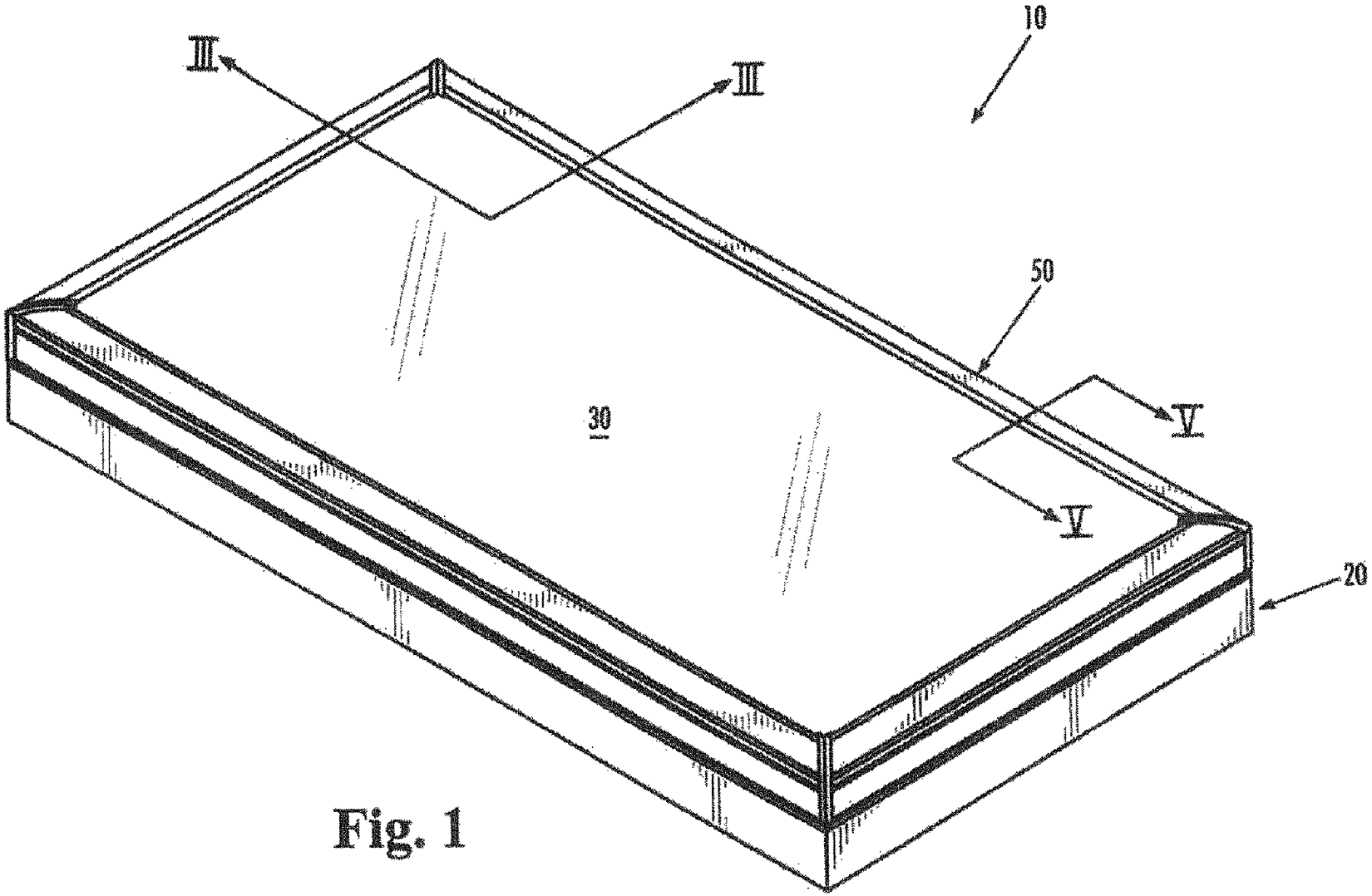
FIG. 1 is an isometric view of a skylight assembly in a closed position.

FIG. 1 is an isometric view of the present skylight assembly 10. The skylight assembly 10 includes a fixed base frame 20 and a moveable sash frame 50. The moveable sash frame 50 houses a transparent or translucent covering element 30. The covering element 30 may be a single glass pane or a pair of glass panes or may include one or more panes made of a material other than glass. For example, the covering element 30 may be a standard insulated glazing unit having two glass panes, the space between the panes being filled with air or an inert gas (such as argon). Additionally, the covering element 30 may include a low-emissivity coating on at least one side to reduce heat loss, while allowing the room to be warmed by sunshine.

Figure 2:
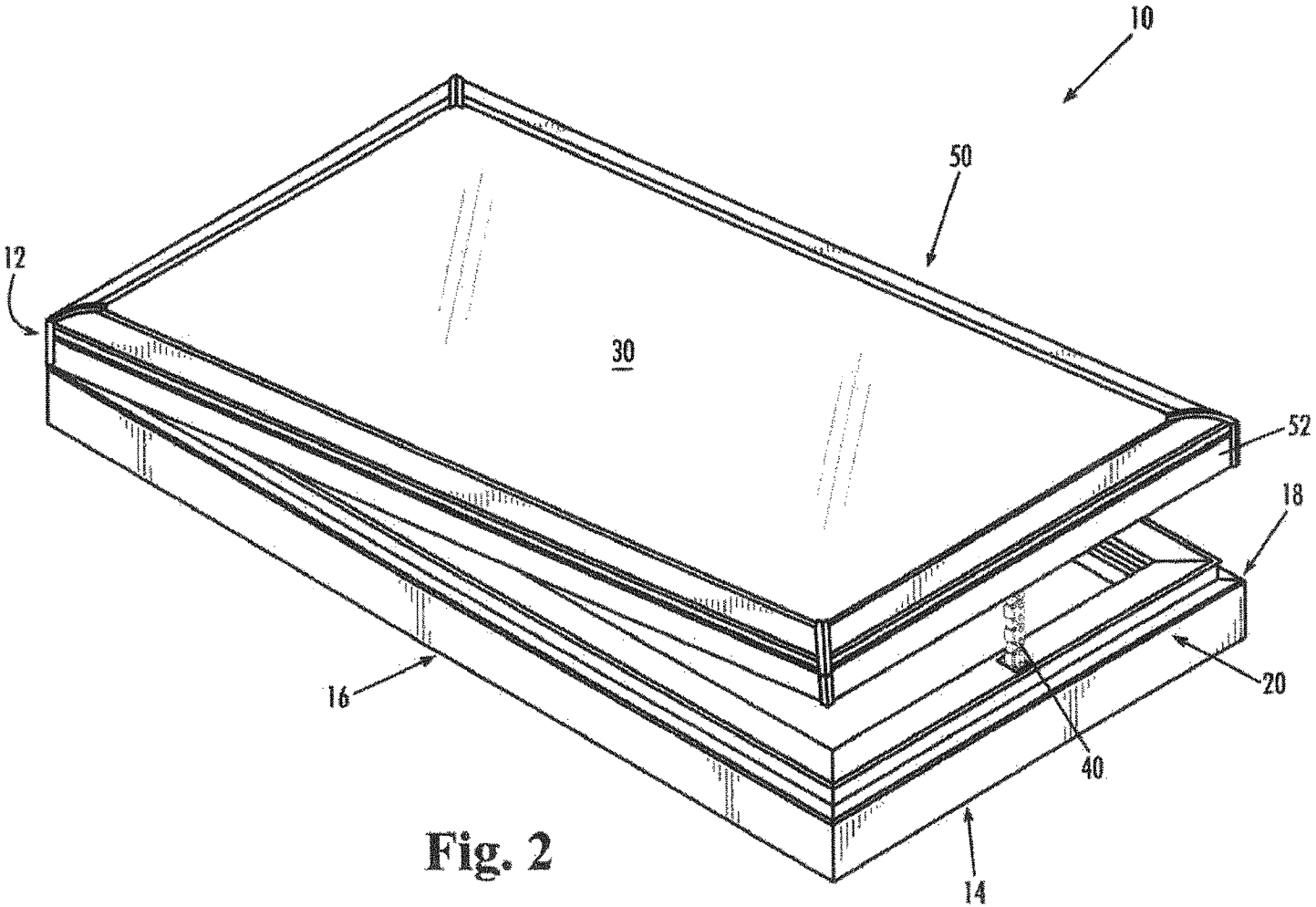
FIG. 2 is an isometric view of the skylight assembly of FIG. 1 in an open position.

FIG. 2 illustrates the skylight assembly 10 in an open position. The skylight assembly 10 has a hinge (or upper) side 12, an operator (or lower) side 14, a left side 16, and a right side 18. As illustrated, the moveable sash frame 50, which includes a sash 52, pivots at the hinge end 12 away from the fixed-base frame 20. A chain 40 extends from the base frame 20 to the sash frame 50, thereby limiting the distance that the covering element 30 (held within the sash frame 50) may extend from the fixed base frame 20. Depending on the size of the skylight 10 and the corresponding length of the chain 40, the maximum opening distance may be between about 9 inches and about 11 inches. The chain 40 is operably connected to an operator or motor (shown in FIG. 10), which may be manually or electrically powered.

Figure 3:
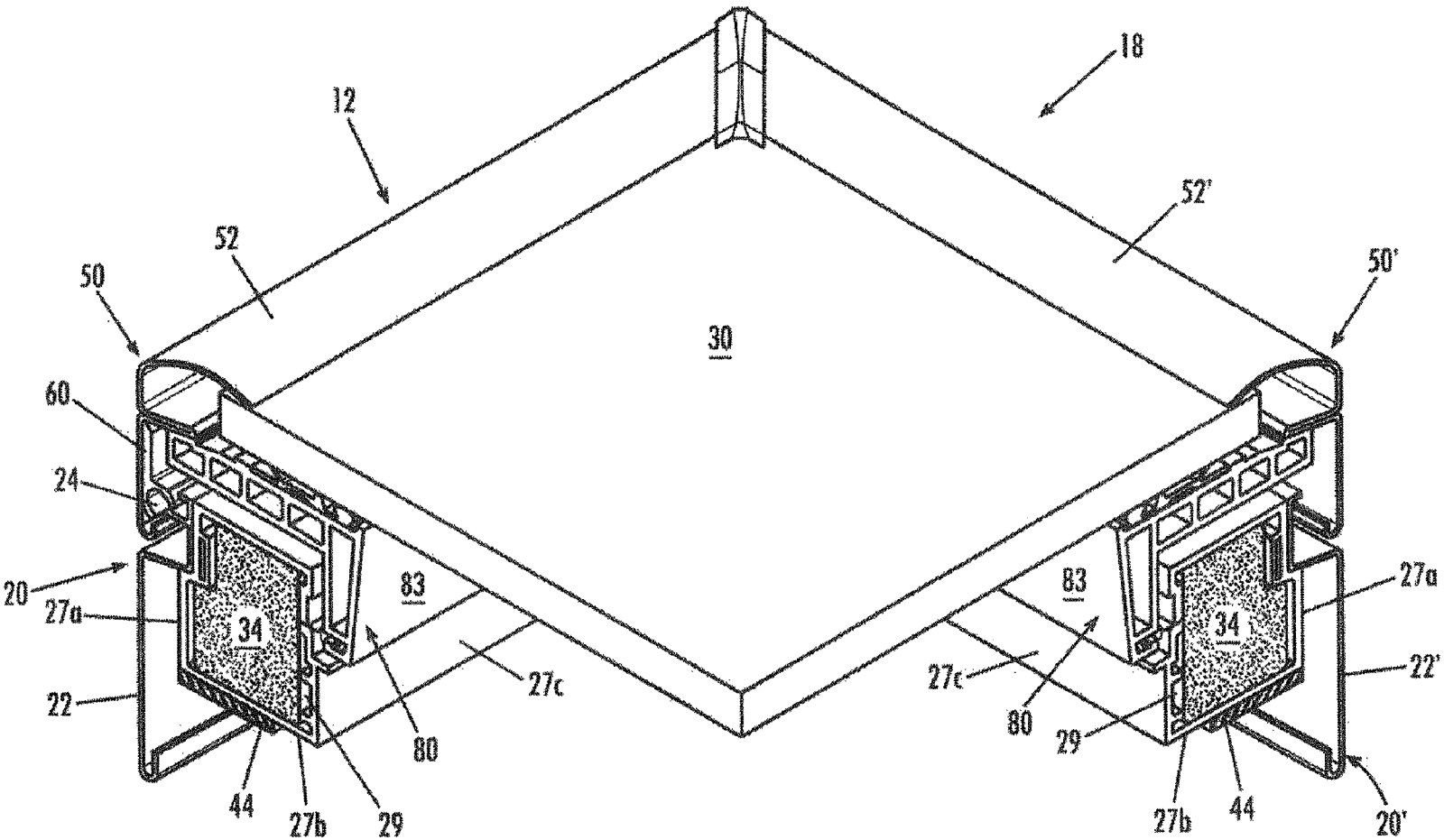
FIG. 3 is a cross-sectional view of the skylight assembly of FIG. 1, as taken along line III-III in FIG. 1.
Figure 8:
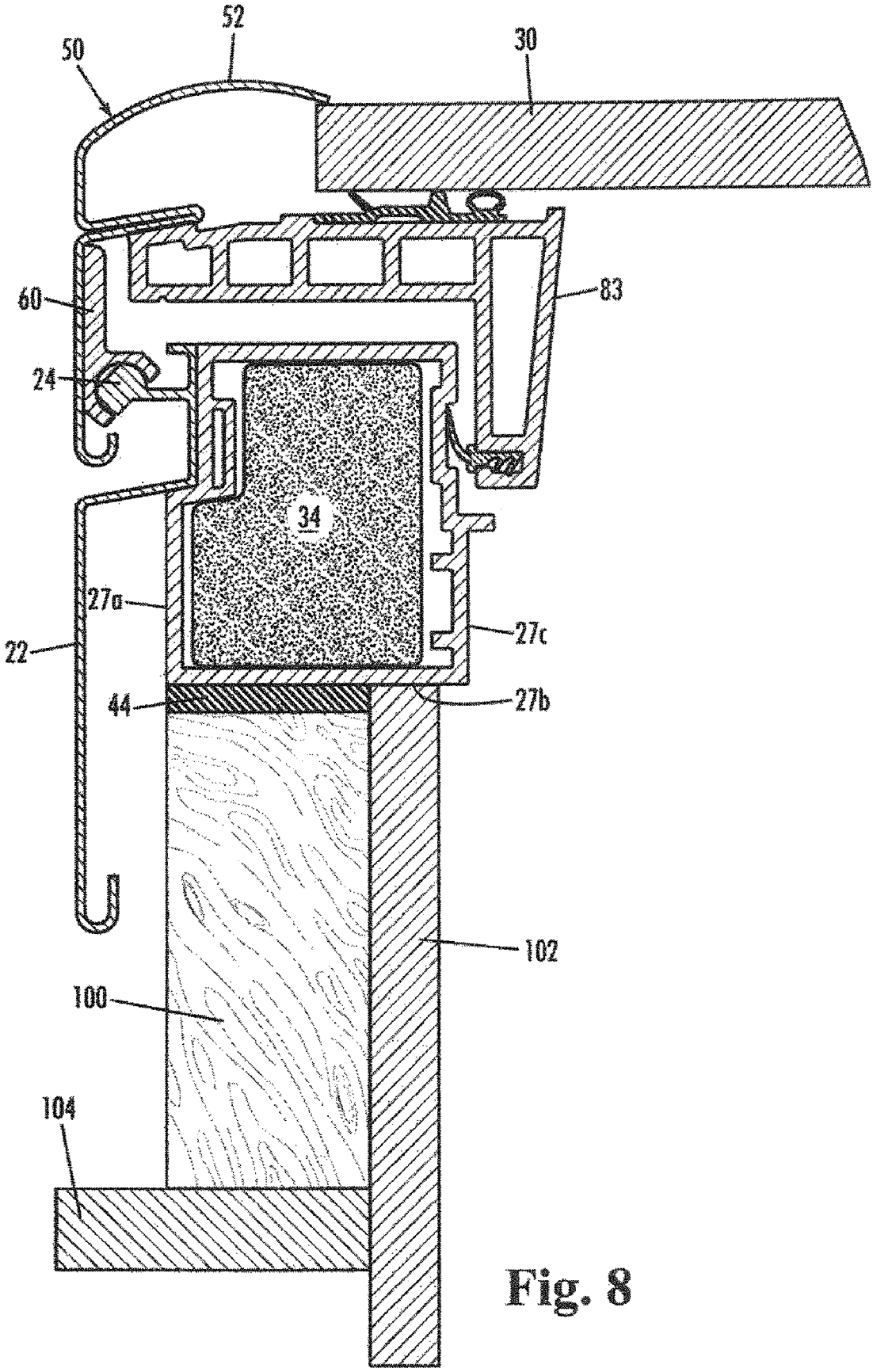
FIG. 8 is a cross-sectional view of the hinge side of the skylight assembly of FIG. 1, as mounted on a curb on a building rooftop.
Figure 11:
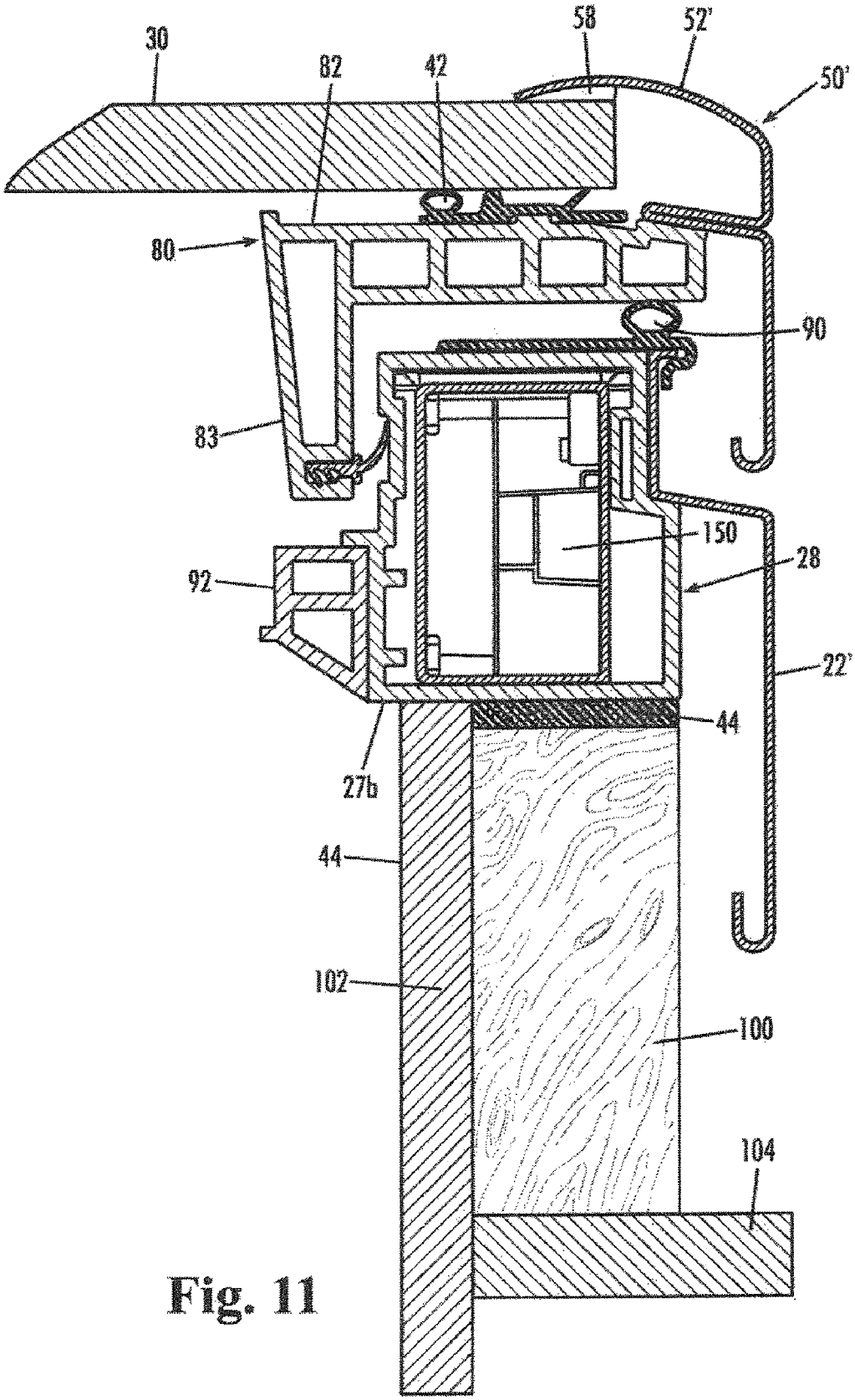
FIG. 11 is a cross-sectional view of the operator side of the skylight assembly of FIG. 1, as mounted on a curb on a building rooftop.

FIG. 3 is a cross-sectional view of the skylight assembly 10, as taken along line III-III of FIG. 1. As shown in the left side of the drawing, the hinge side 12 includes a sash frame 50 having a sash 52 and a hinge member 60 attached to the interior of the sash 52. A cooperative, or complementary, hinge member 24 is integrally formed on the exterior surface of the counter-flashing element 22, which is part of the base frame 20. The base frame 20 further includes an interior frame 28 having a first side 27*a* in close proximity to the counter-flashing element 22, a bottom side 27*b* that is in proximity to the curb when installed, and an interior facing side 27*c* that forms a flat planar surface about the interior of the skylight assembly 10. A closed-cell foam pad 44 may be positioned between the bottom side 27*b* of the interior frame 28 and the curb member (100), as shown in FIGS. 8 and 11.

The hollow interior frame 28 defines a cavity 29 therethrough, which may be at least partially filled with an expanded polystyrene (EPS) foam 34 to minimize condensation, while maintaining a light weight. The EPS foam 34 may be in a single piece along each side or may be in multiple, smaller pieces. Instead of EPS, the foam material 34 may be made of expanded polypropylene (EPP) foam or some other similar foam material.

Turning to the moveable components of the skylight assembly, the sash frame 50 includes the sash 52 to which is attached the hinge member 60, as briefly introduced above. The sash 52 is also connected to an accessory shelf 80 that is hollow and that includes an interior facing planar surface 83 configured for receipt of an accessory, as will be discussed further herein. The covering element 30 rests upon the accessory shelf 80, and the perimeter of the covering element 30 is overlapped by the sash 52 on each side.

The right side of FIG. 3 shows the right side 18 of the skylight assembly. The sash frame 50' includes a sash component 52' and a counter-flashing element 22'. Because the hinge members 24, 60 are located only along the hinge side 12, the construction of the sash components 52' and the counter-flashing elements 22' on the remaining, non-hinge sides is simplified by omitting the hinge members 24, 60 from the right side 18 (as shown), as well as the left side 16 and the operator side 18 (neither of which are shown in this perspective). Accordingly, the sash components 52' include the same exterior profile as the sash component 52, but do not include a hinge member 60. Similarly, the counter-flashing elements 22' provide the same outward appearance, that is, the same profile, as the counter-flashing element 22, but are not fitted with a hinge member 24.

Figure 4:
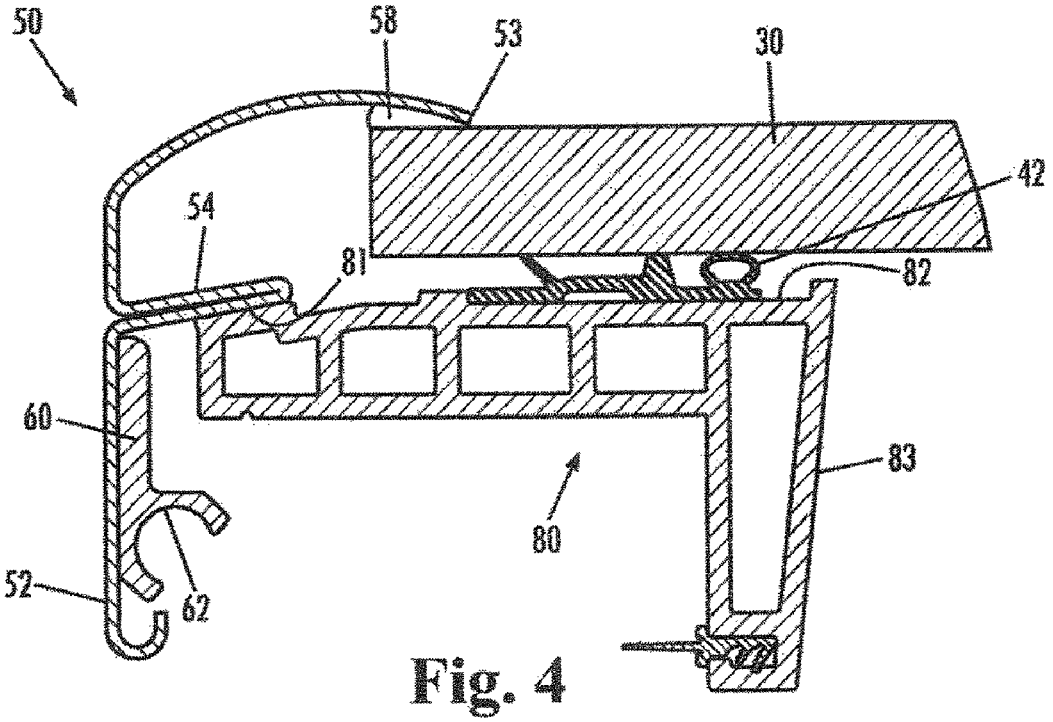
FIG. 4 is a cross-sectional view of a moveable sash frame located on a hinge side of the skylight assembly of FIG. 1, the moveable sash frame including a sash, an accessory shelf, and a hinge member.
Figure 5:
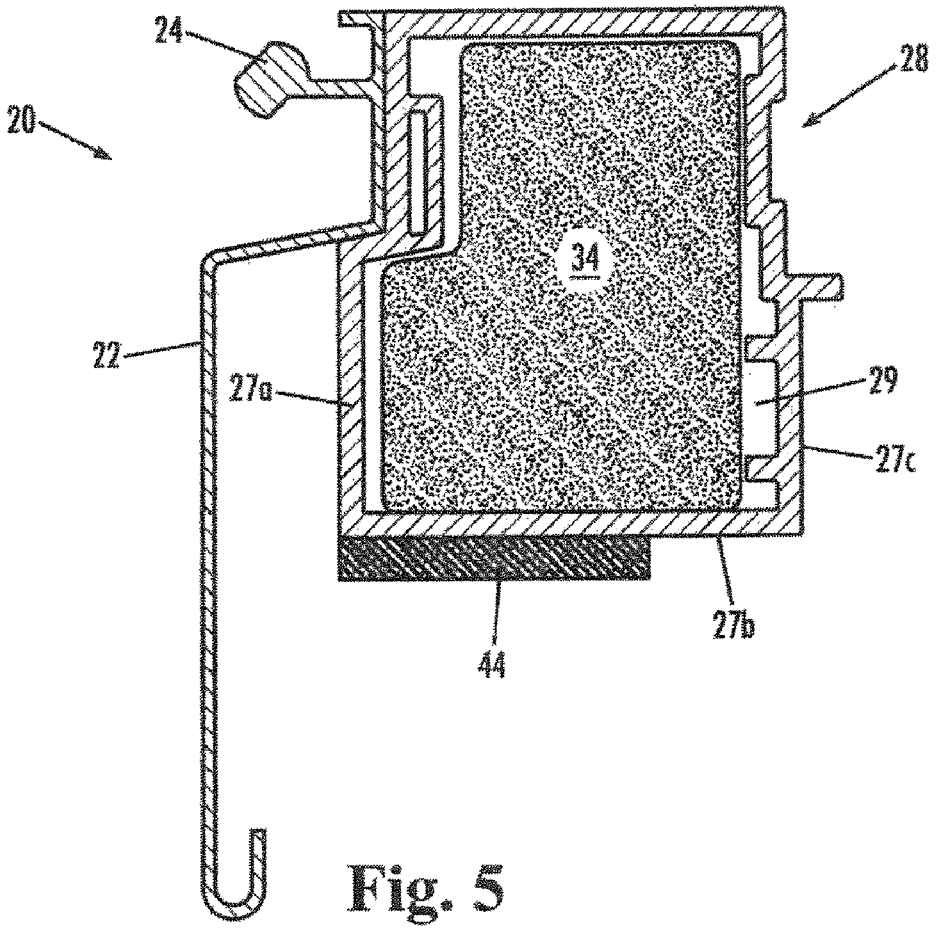
FIG. 5 is a cross-sectional view of a base frame located on a hinge side of the skylight assembly of FIG. 1, the base frame including an interior frame, a counter-flashing element, and a hinge member complementary to the hinge member of FIG. 4.

FIG. 4 shows a cross-sectional view of the sash element, or frame, 50, as may be found on hinge side 12. The sash frame 50 includes a one-piece sash 52 having an end 53 that contacts the covering element 30 and an overlapped portion 54 that contacts a surface 81 of the accessory shelf 80. The sash 52 further extends downwardly into a curved J-shape, which has been found useful to prevent leakage of rain water, for example, into the skylight opening. Attached to the interior side of the downwardly extending portion of the sash 52 is the hinge member 60 that includes a generally C-shaped recess, or socket, 62 for receiving the complementary-shaped hinge member 24 (as shown in FIG. 5). The accessory shelf 80 further includes an upper surface 82 that supports the covering element 30, as shown in FIG. 3, and a planar surface 83 that is configured for receipt of an accessory. A gasket 42 may be positioned between the upper surface 82 of the accessory shelf 80 and the covering element 30.

The planar surface 83 of the accessory shelf 80 may be oriented at an acute angle relative to an imaginary plane extending perpendicularly through the covering element 30. It has been found that an angle of about 6 degrees is well-suited for many applications to compensate for any skew resulting from the installation of the skylight components. Examples of accessories that may be included with the present skylight assembly 10 include roller shades, pleated shades, cellular shades, light-blocking shades, and Venetian blinds. Such accessories may be manually operated or may be operated using electricity provided by an electric operator (not shown). Bracket systems that are suitable for attachment to the planar surface 83 and that may be used to secure an accessory are described, for example, in European Patent Application Publication No. EP 1,857,630 and International Patent Application Publication No. WO 2007/110072, the disclosures of which are hereby incorporated by reference.

FIG. 5 shows the stationary base frame 20 including the interior frame 28 (defining the cavity 29) and the counter-flashing element 22. The hinge member 24 is integral with, and extends from, the upper exterior portion of the counter-flashing element 22. The hinge member 24 includes a rounded component having a shape and size complementary to the socket 62 (shown in FIG. 4). The counter-flashing element 22 may be attached to the interior frame 28 by means of an adhesive, screws or other attachment devices. The particular shape of the interior frame 28 may vary as necessary depending on a particular configuration desired for the skylight assembly. As briefly mentioned above, side 27*c* creates a planar surface suitable for holding a screen.

As may be understood from the foregoing description, an accessory held adjacent to the planar surfaces 83 of the accessory shelf 80 is transported with the moveable sash member 50 when the skylight 10 is opened. By providing additional planar surfaces 27*c* that form a frame for receipt of a screen within the fixed base frame 20, it is assured that unwelcome insects are prevented from entering through the skylight opening, when the sash member 50 is extended.

Figure 6:
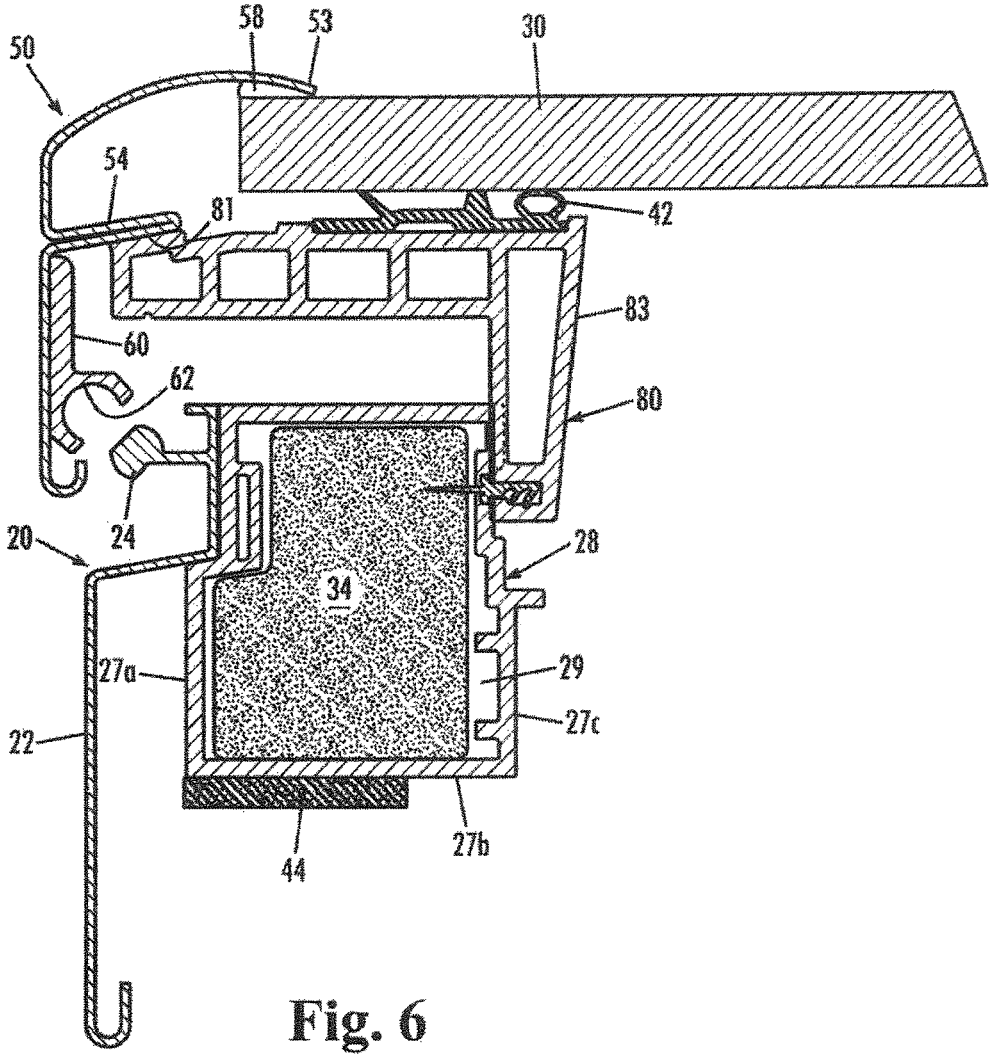
FIG. 6 is an exploded cross-sectional view showing the cooperative hinge members of FIG. 4 and FIG. 5.

FIG. 6 shows the cooperative relationship between the hinge member 60 and the hinge member 24. As shown, the ball-shaped hinge member 24 is received by the socket 62 of the hinge member 60, thereby forming a watertight seal between the hinge members. Further, the configuration of the socket 62 relative to the hinge member 24 provides an interlocking relationship that may only be disengaged when the base frame 20 and the sash frame 50 reach a predetermined angle relative to one another (for example, an angle having a measurement of between about 50 degrees and about 60 degrees). If desired, other angles may instead be employed. By constructing the hinge members 24, 60 in such manner, the sash 50 may be readily removed from the base frame 20 (for example, during installation), while preventing accidental disengagement of the hinges (for example, when the skylight 10 is opened).

Also as shown in FIG. 6, the covering element 30 may be supported by the accessory shelf 80, and a watertight barrier compound 58 may be provided between the end 53 of the sash 52 and the covering element 30. Silicone is one such example of a watertight barrier compound 58, although other compounds may be used.

Figure 7A:
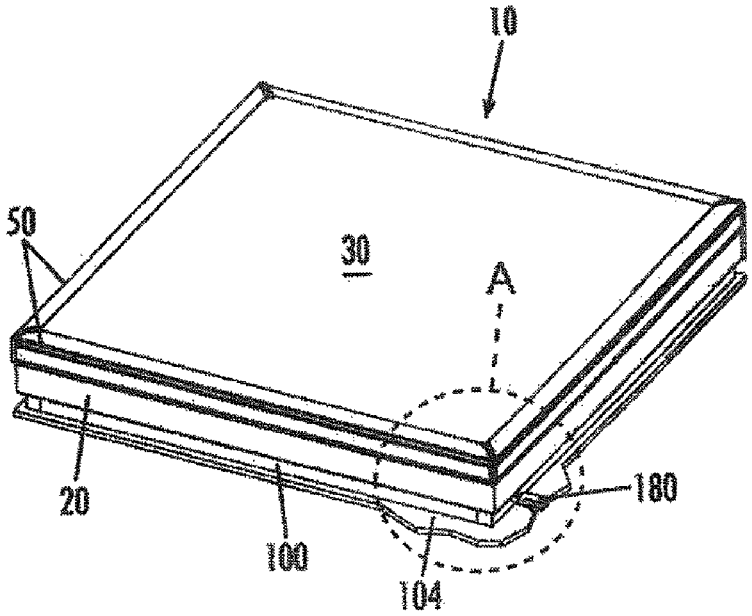
FIG. 7A is a perspective view of the skylight assembly of FIG. 1, as installed on a roof.

The installed skylight 10 may be seen in FIG. 7A. Briefly, the skylight 10 is installed on a plurality of curb members 100 that project upwardly from a building roof 104. The curb members 100 surround an opening in the roof 104, the opening being covered by the skylight 10. The base frame 20 is positioned over the curb members 100 and is secured thereto, and the sash frame 50 holds the covering element 30 above the base frame 20.

Figure 7B:
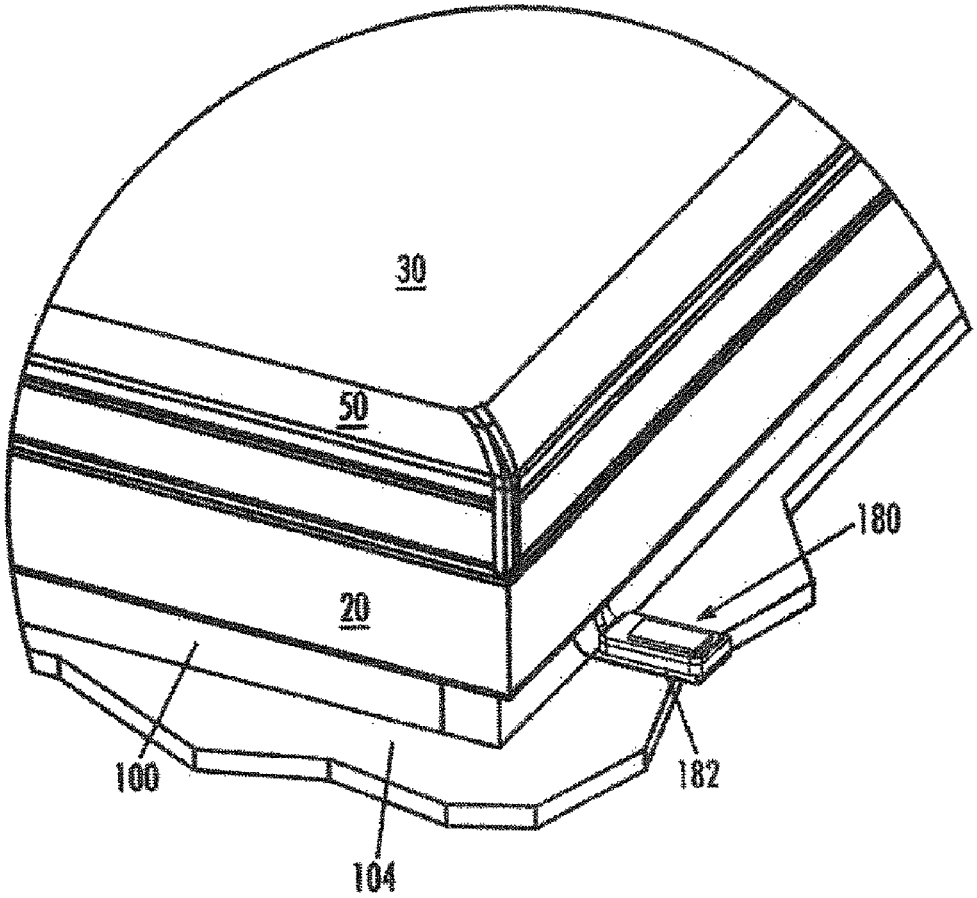
FIG. 7B is an enlarged perspective view of a corner of the installed skylight assembly shown in FIG. 7A, as taken from Detail A of FIG. 7A.

Along one edge of the skylight 10 is positioned a rain sensor 180, as shown in greater detail in FIG. 7B. The rain sensor 180 is operably connected to the operator motor (shown in FIG. 10), such that the activation of the sensor 180 (by rain) causes the motor to close the skylight 10. The rain sensor 180 may be attached directly to the roof 104 proximate the skylight, or the sensor 180 may be attached to the curb member 100 (or to a flashing component, not shown) by means of a bracket 182.

FIG. 8 illustrates the hinge side 12 of the skylight 10, as installed on a rooftop curb 100. The foam pad 44 is positioned between the bottom side 27*b* of the interior frame 28 and the top of the curb member 100 (which, for example, may be made of a 2×4 piece of lumber). The foam pad 44 may include a pressure sensitive adhesive attached to the curb-contacting side thereof to secure the foam pad 44 to the curb 100. The foam pad 44 functions similarly to a gasket, preventing moisture and air from penetrating the skylight 10. The skylight opening may be finished with drywall 102 or some other surface material. The curb 100 may be attached to the roof by nails (for example, by toe-nailing), screws, or other suitable fasteners (not shown).

The hinge members 24, 60 engage one another to form a watertight seal, and the curved ends of the sash 52 and the counter-flashing element 22 prevent the transport of water into the skylight opening, as may occur with rain or snow melt-off. A flashing element (not shown) may extend from the rooftop between the counter-,lashing element 22 and the exterior-facing side 27*a* of the interior frame 28. The counter-flashing element 22 may be provided with a plurality of apertures therethrough (not shown) spaced along the length thereof for receipt of fasteners to secure the skylight 10 to the curb 100. Such fasteners may include screws, nails, and staples. The spacing of the apertures may be dictated by the size of the skylight 10 and by applicable regulations regarding wind uplift.

Further, the accessory shelf 80 provides a shelf surface 83 for receipt of an accessory, such as a shade or blinds, while the interior-facing side 27*c* of the interior frame provides a surface for receipt of a window screen. Thus, from the top-most surface, the skylight assembly may include a covering element 30, an accessory (not shown) that moves in conjunction with the covering element, and a screen (not shown) that remains stationary within the base frame.

Figure 9:
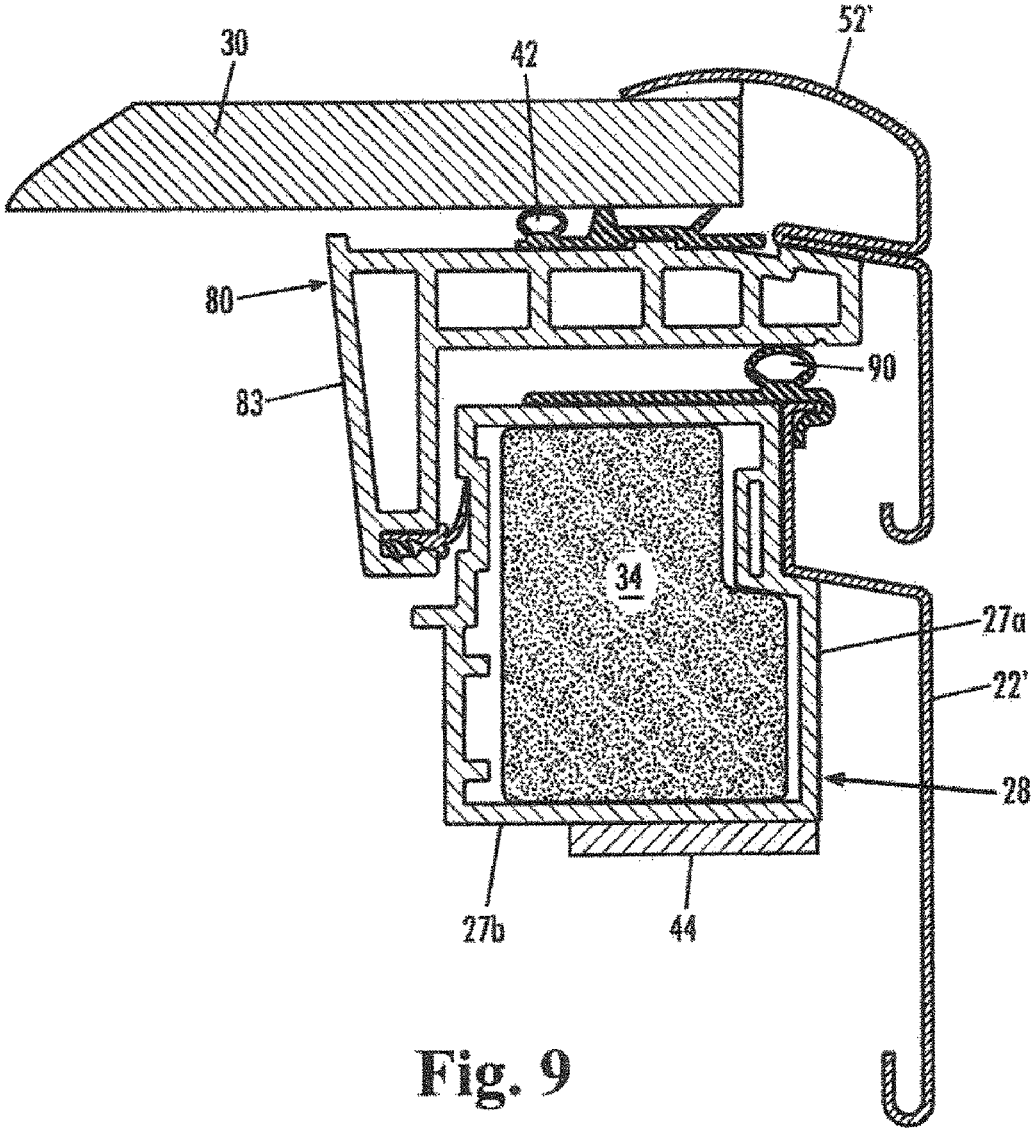
FIG. 9 is a cross-sectional view of a longitudinal side of the skylight assembly of FIG. 1.

FIG. 9 illustrates a longitudinal side (e.g., the right side 18) of the skylight assembly 10 of FIGS. 1 and 2. The covering element 30 may be positioned between the upper side 82 of the accessory shelf 80 and the sash 52' (sash 52' being similar to sash 52, but lacking the hinge member 60). A gasket 42 may be inserted between the upper side 82 of the accessory shelf 80 and the bottom surface of the covering element 30, the gasket 42 extending around the perimeter of the skylight 10, although other means of cushioning the covering element 30 may instead be used. As before, the interior-facing side 83 of the accessory shelf 80 forms a planar surface configured to receive an accessory.

A second gasket 90 may be positioned between the bottom of the accessory shelf 80 and the top of the interior frame 28 (again extending around the perimeter of the skylight 10). The counter-flashing element 22' resembles the counter-flashing element 22 with the exception that the counter-flashing element 22' lacks the integral hinge member 24. The cavity 29 of the interior frame 28 may be filled, or partially filled, with one or more foam components 34.

Figure 10:
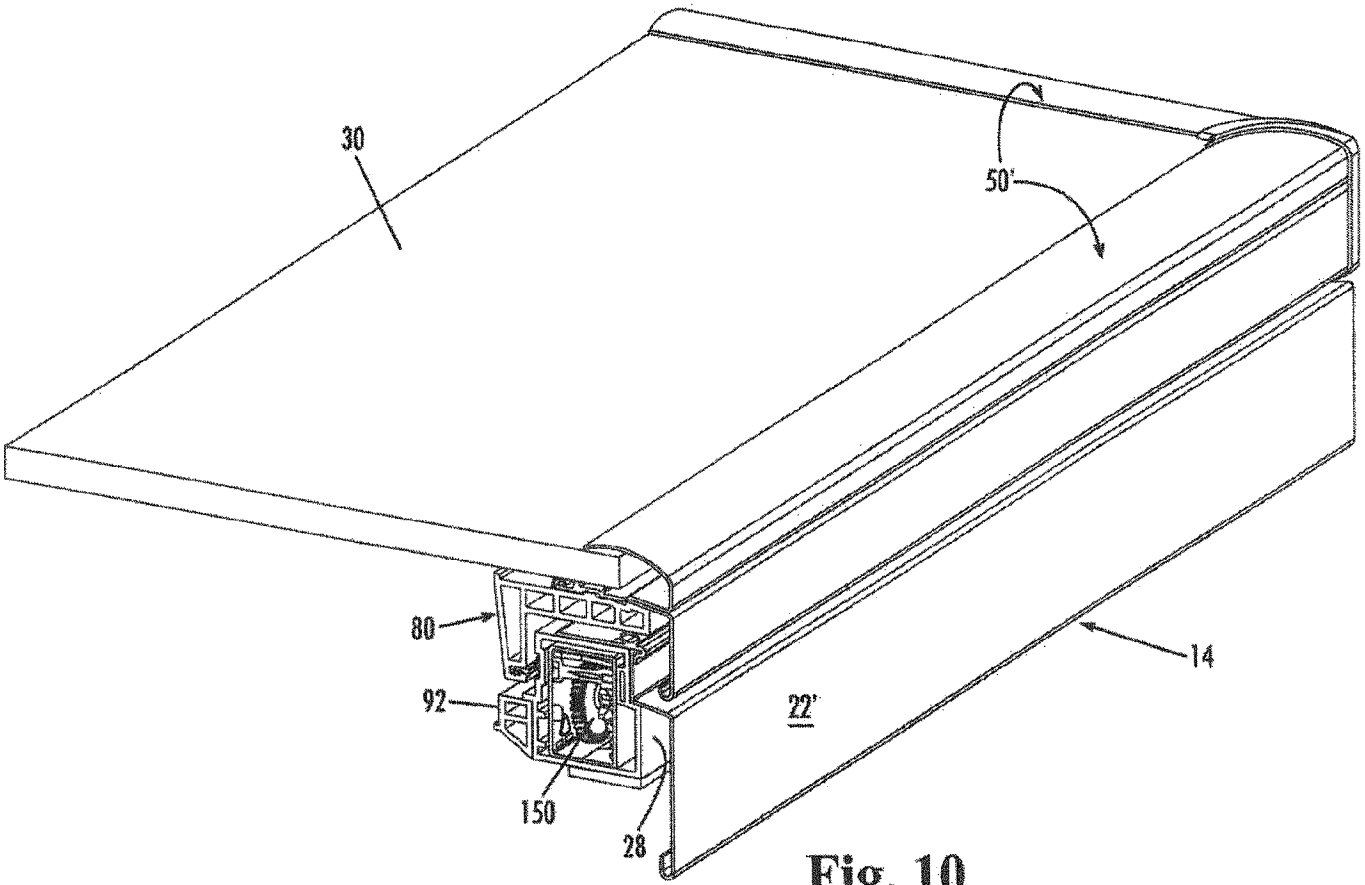
FIG. 10 is an isometric cross-sectional view of the operator side of the skylight assembly of FIG. 1.

FIG. 10 shows the operator, or bottom, side 14 of the skylight assembly 10. A motor-driven chain, or operator, 150 is housed within the cavity (29) of the interior frame 28. The operator 150 may be manually or electrically powered. One or more EPS foam pieces 34 may be inserted into the cavity 29 along the operator side 14 to fill any voids surrounding the motor, or operator. Additionally, the interior-facing side of the interior frame 28 includes a screen retainer 92 configured to hold a screen (not shown).

FIG. 11 shows the operator side 14 of the skylight assembly 10, as installed on a rooftop curb 100. As shown in FIG. 8, the cut opening for the skylight may be finished with drywall 102 or another building material.

The preceding discussion merely illustrates the principles of the present ventilating skylight 10. It will thus be appreciated that those skilled in the art will be able to devise various arrangements, which, although not explicitly described or shown herein, embody the principles of the invention and are Included within its spirit and scope. Furthermore, all examples and conditional language recited herein are principally intended expressly to be only for pedagogical purposes and to aid the reader in understanding the principles of the inventions and the concepts contributed by the inventor(s) to furthering the art and are to be constued as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal", "vertical", "above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not required that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, as well as both movable or rigid attachments or relationships, unless expressly described otherwise.

The foregoing description provides a teaching of the subject matter of the appended claims, including the best mode known at the time of filing, but is in no way intended to preclude foreseeable variations contemplated by those of skill in the art.

We claim:

1. A ventilating curb-mounted skylight assembly for an opening in a building, the skylight assembly comprising:

(a) a rigid plastic curb frame comprising a fixed base frame and a movable sash frame and defining a hinge side, an operator side opposite the hinge side, a left side, and a right side, the fixed base frame comprising, on each side, an interior frame and a counter-flashing element carried by the interior frame, the interior frame having opposing side walls, a bottom side and an opposing top side, thereby defining a hollow interior, the counter-flashing element on the hinge side comprising a first hinge member, the first hinge member extending from the counter-flashing element, the movable sash frame comprising, on each side, an accessory shelf and a sash carried by the accessory shelf, the sash on the hinge side comprising a second hinge member, the second hinge member being carried by the sash and being configured in a shape complementary to the first hinge member, the second hinge member being releasable from the first hinge member when the base frame and the sash frame are positioned at a predetermined angle relative to each other;

(b) a transparent or translucent covering element disposed between the accessory shelf and the sash; and (c) an operator, the operator configured for moving the moveable sash frame and covering element, the operator being disposed within the, interior frame.

2. The skylight assembly of claim 1, wherein the hinge member carried by the counter-flashing element includes a ball and the hinge member carried by the sash includes a socket configured for receipt of the ball.

3. The skylight assembly of claim 1, wherein the predetermined angle is in the range of about 45 degrees to about 60 degrees.

4. The skylight assembly of claim 1, wherein the covering element comprises an integrated glazing unit.

5. The skylight assembly of claim 1, wherein the covering element comprises a coating to minimize ultraviolet transmission.

6. The skylight assembly of claim 1, further comprising at least one of a gasket positioned between the accessory shelf and the covering element and a watertight barrier compound between the covering element and the sash.

7. The skylight assembly of claim 6, wherein the watertight barrier compound is silicone.

8. The skylight assembly of claim 1, further comprising insulating material disposed within the interior frame.

9. The skylight assembly of claim 1, wherein the operator is a manual operator.

10. The skylight assembly of claim 1, wherein the operator is an electric motor.

11. The skylight assembly of claim 10, further comprising a rain sensor, the rain sensor being in cooperative relationship with the electric motor to close the skylight when the rain sensor is activated.

12. The skylight assembly of claim 1, wherein the interior frame defines planar surfaces on the interior of the skylight assembly opposite the counter-flashing element and sash element, the planar surfaces being perpendicular to the covering element and being configured for receipt of a window screen.

13. The skylight assembly of claim 12, wherein the operator side of the interior frame comprises a screen retaining element.

14. The skylight assembly of claim 13, further comprising a screen.

15. The skylight assembly of claim 1, wherein the accessory shelf comprises a planar surface, the planar surface being oriented at an acute angle relative to a plane extending perpendicularly through the covering element.

16. The skylight assembly of claim 15, wherein the acute angle is approximately 6 degrees.

17. The skylight assembly of claim 15, further comprising an accessory selected from the group consisting of roller shades, pleated shades, cellular shades, and light-blocking shades.

18. The skylight assembly of claim 15, further comprising an accessory, the accessory being blinds.

19. A ventilating curb-mounted skylight assembly for an opening in a building, the skylight assembly comprising:

(a) a rigid plastic curb frame comprising a fixed base frame and a movable sash frame and defining a hinge side, an operator side opposite the hinge side, a left side, and a right side, the fixed base frame comprising, on each side, an interior frame, and a counter-flashing element carried by the interior frame, the interior frame defining an interior cavity, the counter-flashing element on the hinge side defining a profile, the profile including a first hinge member, the movable sash frame comprising, on each side, an accessory shelf and a sash carried by the accessory shelf, the accessory shelf defining a width greater than the width of the interior frame, the sash on the hinge side comprising a second hinge member, the second hinge member being carried by the interior of the sash and being configured in a shape complementary to the first hinge member, the second hinge member being releasable from the first hinge member when the base frame and the sash frame are positioned at a predetermined angle relative to each other; and (b) a transparent or translucent covering element disposed between the accessory shelf and the sash; and (c) an electric motor, the electric motor configured for moving the moveable sash frame and covering element and disposed within the interior frame.

* * * * *